United States Patent [19]

Trine

[11] Patent Number: 4,978,125

[45] Date of Patent: Dec. 18, 1990

[54] PORTABLE, HAND AGITATED RANDOM SELECTOR DEVICE

[76] Inventor: David Trine, 2540 Mountain La., #19, Allentown, Pa. 18103

[21] Appl. No.: 459,943

[22] Filed: Jan. 2, 1990

[51] Int. Cl.[5] ..... A63F 7/04

[52] U.S. Cl. ..... 273/144 B

[58] Field of Search ..... 273/144 R, 144 A, 144 B, 273/145 R, 145 B, 145 C, 1 L; 124/62

[56] References Cited

U.S. PATENT DOCUMENTS

| | | | |
|---|---|---|---|
| 2,450,830 | 10/1948 | Helberg et al. | 124/62 |
| 2,580,613 | 12/1950 | Seibel et al. | 124/62 |
| 2,681,055 | 6/1954 | Gowland | 124/62 |
| 4,616,831 | 10/1986 | Testerman | 273/144 B |

FOREIGN PATENT DOCUMENTS

| | | | |
|---|---|---|---|
| 791383 | 6/1980 | U.S.S.R. | 273/144 A |

*Primary Examiner*—Edward M. Coven
*Assistant Examiner*—Valerie Szczepanik
*Attorney, Agent, or Firm*—John J. Selko

[57] ABSTRACT

A portable, hand agitated, transparent, random selector device has a spherical mixing chamber, with a plurality of ejectable indicator units therein. A fluid-carrying tubular conduit extends through the chamber, with an aperture in the conduit for receiving the units, one at a time. The conduit has a first and second end terminating outside of the chamber. Fluid, such as the breath of the user, is blown into the first conduit end and carries the indicator units, along with the fluid out to the second end.

16 Claims, 3 Drawing Sheets

PORTABLE, HAND AGITATED RANDOM SELECTOR DEVICE

BACKGROUND OF THE INVENTION

This invention relates to a device for randomly selecting an indicator unit from a mixing chamber, and is usable as an amusement or game device or as a device for randomly selecting numbers for games of chance, such as lotteries.

SUMMARY OF THE INVENTION

Disclosed herein is a hand operated, portable random selector device having a hollow, hand agitated, mixing chamber, with ejectable indicator units therein. A fluid-carrying conduit has a portion extending within the chamber and a first and second end terminating outside the chamber. The units can enter one at a time into the conduit within the chamber, for movement therethrough to the second end. The first end is connected to a source of fluid pressure, which can be a user's lungpower. Fluid moving through the conduit carries the units to the second end where they are stopped and retained, and where the fluid is vented. The units can be marked with a number or other indicia such as a mark corresponding to each card in a conventional deck of playing cards. An alternative embodiment provides for a closed system, with a conventional pumping device for the fluid pressure source, and the fluid being either gas or liquid.

DETAILED DESCRIPTION OF THE PREFERRED EMBODIMENT AND BEST MODE

Figure 1:
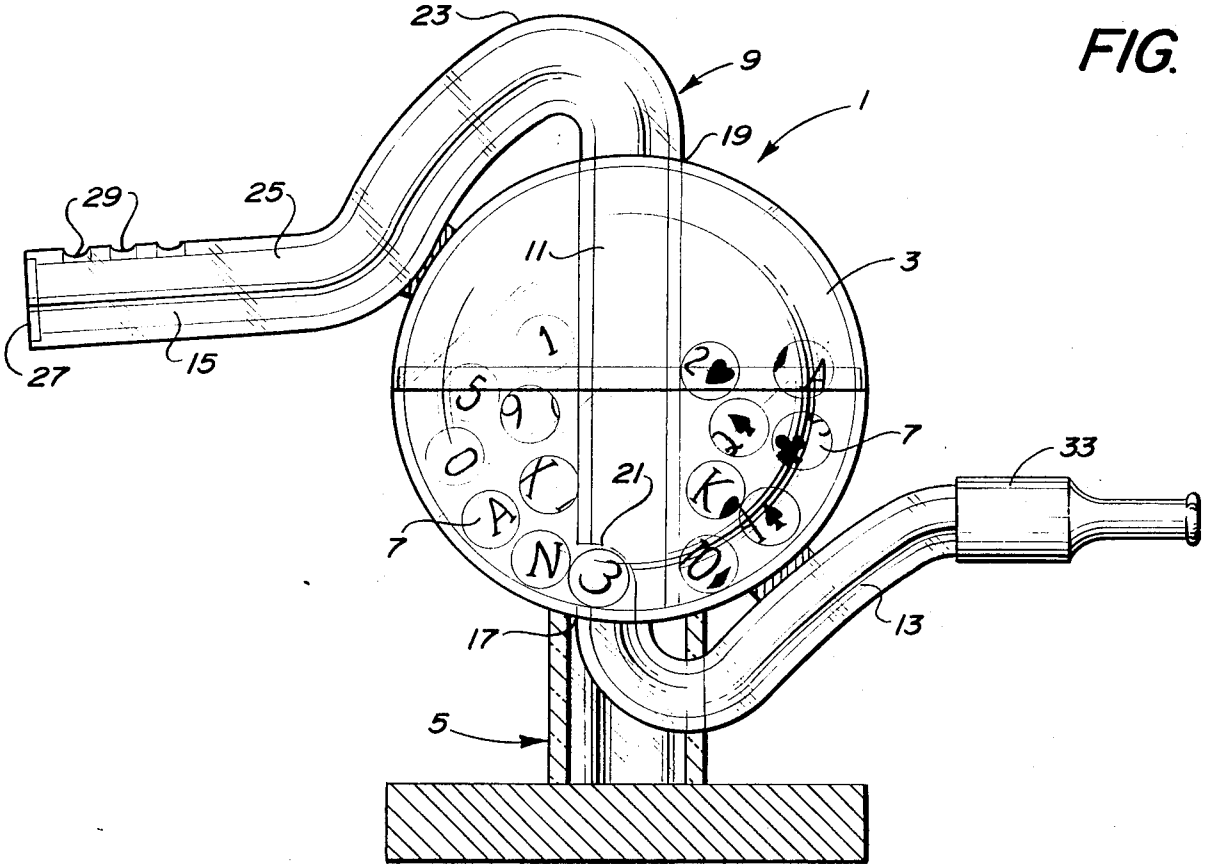
FIG. 1 is a front elevation of the invention with a transparent mixing chamber and transparent conduit means, and part of the base removed.

Referring to FIG. 1, the invention is shown generally at 1, having a closed, hollow mixing chamber 3, fixed to a base 5, with a plurality of indicator units 7, therein. Preferably, the invention is portable, and of a size and weight to permit hand mixing by shaking and also constructed of material that is transparent so as to permit observation of the indicator units as they are ejected.

Tubular fluidic conduit means 9, for conducting a fluid therethrough has a portion 11, extending within chamber 3, and also has a first end 13 and a second end 15 terminating outside chamber 3. Conduit means 9 enters chamber 3 at an aperture in first wall portion 17 and exits chamber 3 at an aperture in second wall portion 19 oppositely disposed from wall portion 17. Conduit means 9 is fixed to the chamber 3 at wall portions 19 and 17 by conventional means, such as adhesive or epoxy. A threaded joint will also work.

Aperture means 21 in conduit portion 11 is an opening large enough to permit entry of indicator units one at a time into conduit portion 11. Opening 21 can be located anywhere along conduit portion 11, but preferably is located adjacent a wall portion (shown as 17) forming the bottom of chamber 3, when the device is resting on base 5. This location permits units 7 to automatically feed into conduit portion 11 one at a time.

Conduit portion 11 and second end 15 have an internal passageway large enough to permit indicator units 7 to pass therethrough along with fluid, as described hereinafter. The internal passageway of first end 13 is smaller than indicator units 7, so as to prevent such units 7 from entering therein. Preferably, indicator units 7 are substantially spherical balls and conduit means 9 is a passageway which, in transverse cross section, is circular, with a diameter in portions 9 and second end 15 slightly larger than the diameter of balls 7, but with a diameter in first end 13 slightly smaller than the diameter of balls 7.

Figure 3:
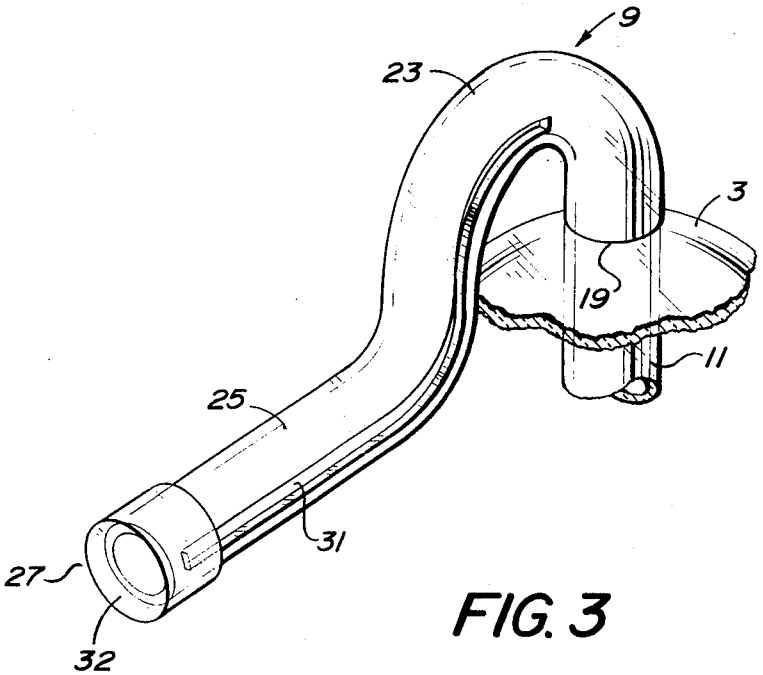
FIG. 3 is a perspective view of a portion of the second end of the transparent conduit means.
Figure 2:
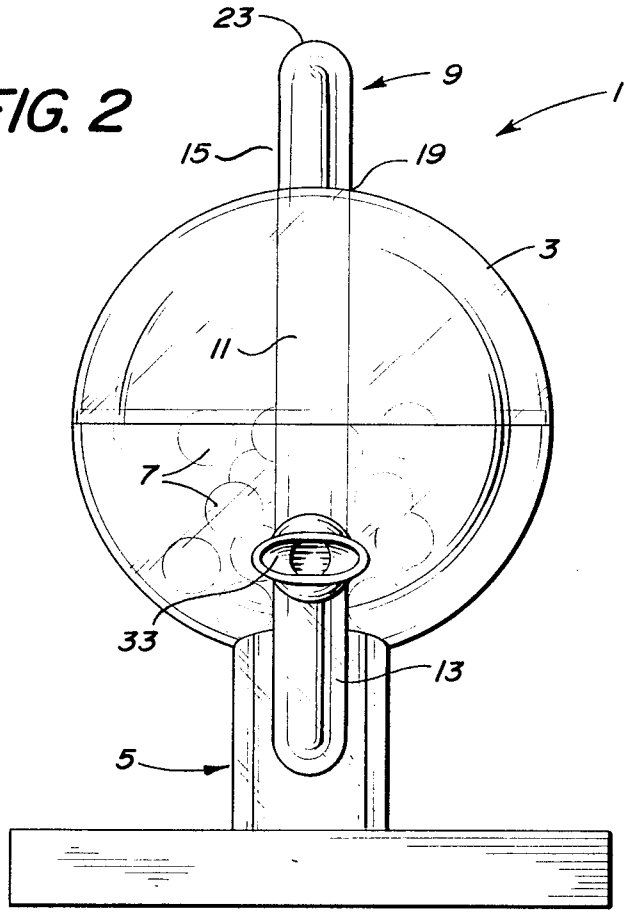
FIG. 2 is a side elevation of the invention of FIG. 1.

Second end 15 forms a U-shaped gooseneck 23 adjacent chamber 3, to result in an abrupt change of direction of the passageway therein, so as to prevent ejected units 7 from reentering chamber 3, unless the user tilts the device. After end 15 forms gooseneck 23, it forms a straight portion 25, generally horizontal with respect to the base 5, of sufficient length to display a plurality (preferably six) of ejected units 7. Straight portion 25 ends at a terminus 27 that is substantially closed, but straight portion 25 contains vent means 29 for passing fluid. Vent means 29 can be any arrangement of apertures through a wall of second end 15. However, as is shown in FIG. 3, an elongated slot 31 extending through a wall of second end 15 into interior thereof is preferred. For best fluid flow, slot 31 extends longitudinally along the length of second end 15 from about the curved portion of the U-shaped gooseneck 23 to adjacent the terminus of second end 15. A removable cap 32 closes end 15. Slot 31 wide should be made enough to permit the user of the device to have finger contact with ejected units 7 thereunder, so as to permit rotation thereof to a readable position, but still retain the units 7 inside second end 15.

Terminus 27 is substantially closed by plugging or by having its passageway reduced to a size that prohibits passage of units 7. Other means (not shown) can be used for stopping units 7, such as an element projecting into second end 15 to prevent passage of units 7. An alternative arrangement would be to permit units 7 to be carried completely out of second end 15 into a suitable receptacle, such as a basket attached to terminus 27 or into the hand of the user. In that case, the units would be reinserted into chamber 3 at a suitable time, either through second end 15 or by disassembly of chamber 3, as described hereinafter.

Preferably, the source of fluid is to be the user's lungpower and the fluid to be breath or gas blown by the user. For sanitary purposes, a disposable mouthpiece 33 is detachably affixed to the terminus 35 of first end 13. As is shown in FIG. 4, a removable filter 37 within the mouthpiece 33 is optional.

Figure 4:
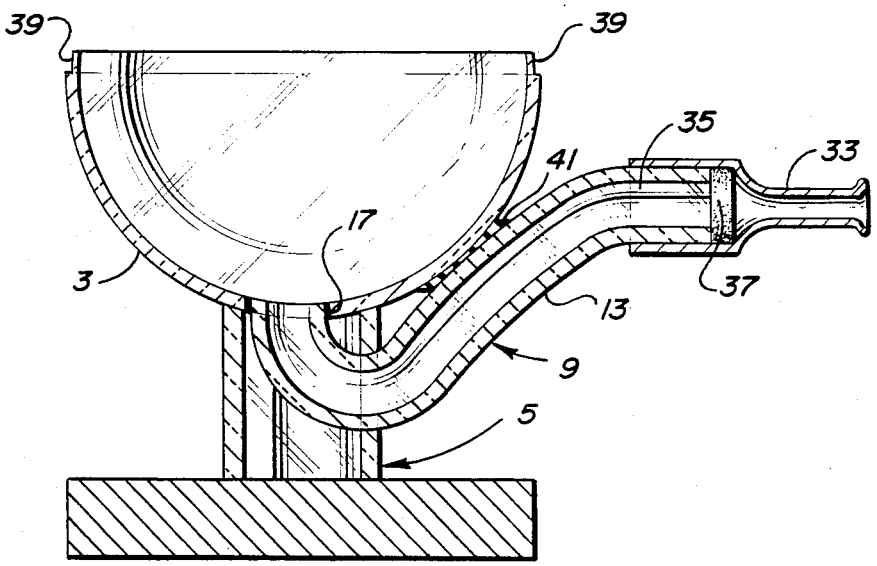
FIG. 4 is a front elevation, with parts removed, of the lower half of the invention, with a transparent spherical mixing chamber and transparent conduit means.
Figure 5:
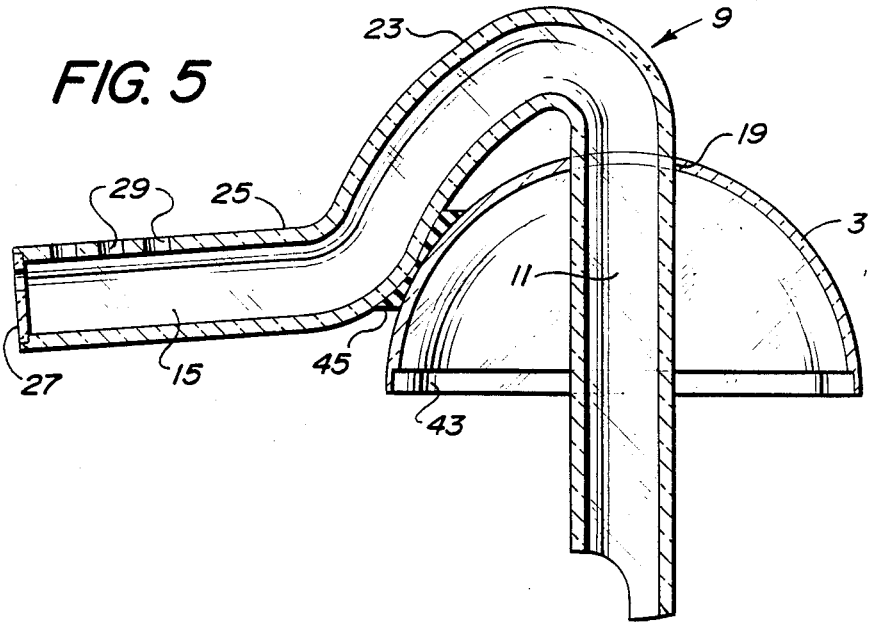
FIG. 5 is front elevation, with parts removed, of the upper half of the invention, with a transparent spherical mixing chamber and transparent conduit means.

Referring to FIGS. 4 and 5, the preferred method of assembling the invention will be described. As shown in FIG. 4, chamber 3 is provided as the lower half of a sphere, although any regularly shaped hollow object will work, such as a cube or other polyhedron. The walls of the sphere form a flanged portion 39 on the inner surface of chamber 3 at about the diameter, or diameter, of the sphere. First end 13 enters chamber 3 at first wall portion 15, which wall portion 15 is located at about the south pole of the sphere. First end 13 to is fastened to first wall portion 17 as described hereinabove, and provides a passageway for fluid to pass through first end 13 and into chamber 3. The internal passageway in first end 13 is smaller than the largest dimension of units 7, so as to prevent units 7 from entering first end 13 as described hereinabove. Support strut 41 connects first end 13 and chamber 3 for rigidity.

Referring now to FIG. 5, an upper half of a sphere has flanged portion 43 on the outer surface of chamber 3. Flanged portions 39 and 43 overlap and can be permanently joined together with conventional adhesives. However, the joint should not be a permanent joint but a friction fit in which the lower half of the sphere is flexibly squeezed, or deformed, to fit into the upper half of the sphere, so long as the assembled sphere is substantially fluid-tight. The preferred joint permits disassembly of the sphere for insertion of units into chamber 3.

Conduit portion 11 enters chamber 3 at second wall portion 19, which wall portion 19 is located at about the north pole of the sphere. Conduit portion 11 extends diametrically across chamber 3 a precise distance that is sufficient to contact inner wall of chamber 3 at the bottom of the sphere at first wall portion 17, the contact being substantially fluid-tight. The center point of internal passageway of portion 11 is concentrically aligned with the center point of passageway of first end 13, so as to provide a substantially continuous and fluid-tight passageway, when the top and bottom sphere halves are attached together. The passageway of conduit portion 9 and second end 15 is slightly larger than the largest dimension of units 7, so as to permit units 7 to be carried therethrough by the fluid flowing therein. Support strut 45 connects second end 15 and chamber 3 for rigidity.

In an alternative embodiment, both ends 13 and 15 can be connected to a source of fluid pressure, such as a bellows or conventional fluid pumping device, to make the system a closed system. By appropriate operation of the fluid pressure source and manipulation of the mixing chamber the units can be moved back and forth into and out of chamber 3. In this alternative embodiment, the fluid can be a gas or a liquid.

A device has been successfully used having units 7 that are balls of ½ inch (½") diameter; with passageway in conduit portion 11 and end 15 being ⅝ inch (⅝"); and passageway in end 13 being ⅝ inch (⅝"). The indicator units 7 are individually marked with a single number or a letter of the alphabet, or with a marking corresponding to a single card in a conventional deck of playing cards. The numbers used are cardinal numbers selected from a series ranging from zero to nine, inclusive. When the device is used for random selection of lottery numbers, each cardinal number is present as a group of units consisting of at least three of the same cardinal numbers per group, depending upon the numbers to be selected for the lottery.

In operation, the device is used as follows: The user mixes the units 7 in chamber 3 by grasping the device at ends 13 and 15 and shaking it by hand. The user allows a unit 7 to enter the opening in conduit portion 11, and thereafter blows into mouthpiece to eject the unit 7 to end 15, where it is stopped for display. Thereafter, the user can repeat the procedure, being careful not to cause the ejected unit 7 to return to chamber 3, or can allow the units 7 to feed automatically into conduit portion 11 one at a time by gravity, whereupon each unit 7 is ejected by blowing into mouthpiece 33. At the end of the user's turn, the device is tilted so as to allow the ejected units 7 to move back into chamber 3 in preparation for another cycle.

I claim:

1. a random selection device comprising:

a. a closed, hollow mixing chamber;

b. a plurality of ejectable indicator units in said chamber;

c. tubular fluidic conduit means for conducting a fluid therethrough, said conduit means extending within said chamber and having a first and second end terminating outside said chamber, said second end terminating at a substantially closed end, said conduit means entering said chamber at a first wall portion and exiting said chamber at a second wall portion, said conduit means having an internal passageway large enough to permit said indicator units to pass through the portion extending within said chamber and into said second end but not said first end;

d. aperture means in said conduit portion within said chamber for permitting entry of said indicator units one at a time into said conduit portion for flow therethrough; and e. means for connecting said first end of said conduit means to a source of fluid pressure to drive said indicator units through said conduit to said second end.

2. The invention of claim 1 in which said aperture means is an opening located adjacent said first wall portion of said chamber.

3. The invention of claim 2, further including means on said second end of said conduit means for stopping said ejected indicator units and vent means for venting fluid.

4. The invention of claim 3 in which said second end forms a U-shaped bend adjacent said chamber, for deterring ejected indicator units from re-entering said chamber, followed by a straight portion of sufficient length to receive a plurality of ejected indicator units, said straight portion terminating at a substantially closed end.

5. The invention of claim 4 further including support means for supporting said chamber upright on a horizontal surface.

6. The invention of claim 5 in which said second end of said conduit means is transparent.

7. The invention of claim 6 in which said indicator units are substantially spherical shaped balls, and said conduit means, in transverse cross section, is substantially circular, said conduit means having an internal diameter in said second end and in said portion within said chamber slightly larger than the diameter of said balls, and having an internal diameter in said first end slightly smaller than the diameter of said balls.

8. The invention of claim 7 in which said chamber is spherical and said conduit portion within said chamber extends substantially vertically across the diameter thereof.

9. The invention of claim 8 in which said fluid is gas, said source of fluid pressure is human lungpower and said means for connecting said first end of said conduit means to said source of fluid pressure is a removable mouthpiece.

10. The invention of claim 9 in which said mouthpiece includes a removable filter.

11. The invention of claim 4 in which said vent means is an elongated slot extending through a wall of said second end into the interior thereof, said slot extending along the length of said second end from about the curved part of said U-shaped portion to adjacent said closed end of said straight portion.

12. The invention of claim 11 in which the chamber is transparent.

13. The invention of claim 12 in which each indicator unit is marked with a different cardinal number selected from a series ranging from zero to nine, inclusive.

14. The invention of claim 13 in which said slot is wide enough to permit finger contact with said indicator units thereunder, so as to permit rotation of said indicator units to a readable position.

15. The invention of claim 4 in which said vent means is a plurality of apertures extending through a wall of said second end into the interior thereof, said apertures located adjacent the terminus of said second end.

16. The invention of claim 13 in which each cardinal number is present as a group of units consisting of at least three of the same cardinal numbers per group.

* * * * *